US005295317A

United States Patent [19]

Perrott

[11] Patent Number: 5,295,317

[45] Date of Patent: Mar. 22, 1994

[54] APPARATUS FOR EXCAVATING EARTHEN MATERIAL BY EVACUATION OF SAME

[76] Inventor: Kenneth W. Perrott, P.O. Box 70345, Eugene, Oreg. 97401

[21] Appl. No.: 945,913

[22] Filed: Sep. 17, 1992

[51] Int. Cl.[5] ..... E21B 21/06; E02F 3/88

[52] U.S. Cl. ..... 37/348; 37/347; 37/905; 175/66

[58] Field of Search ..... 37/905, 318, 320, 323, 37/317, 347, 348; 175/65, 66, 67, 206, 209, 213, 424; 210/785, 767, 805, 172, 358, 383, 384

[56] References Cited

U.S. PATENT DOCUMENTS

| | | | |
|---|---|---|---|
| 4,854,058 | 8/1989 | Sloan et al. | 37/320 X |
| 4,936,031 | 6/1990 | Briggs et al. | 37/347 |
| 5,016,717 | 5/1991 | Simons et al. | 175/66 |
| 5,083,386 | 1/1992 | Sloan | 37/318 X |
| 5,109,933 | 5/1992 | Jackson | 175/66 |
| 5,129,468 | 7/1992 | Parmenter | 175/66 |
| 5,129,469 | 7/1992 | Jackson | 175/66 |
| 5,140,759 | 8/1992 | Artzberger | 37/347 |

FOREIGN PATENT DOCUMENTS

| | | | |
|---|---|---|---|
| 222223 | 12/1983 | Japan | 37/905 |

*Primary Examiner*—Randolph A. Reese
*Assistant Examiner*—J. Russell McBee
*Attorney, Agent, or Firm*—James D. Givnan, Jr.

[57] ABSTRACT

An apparatus supported on a truck bed and including a high pressure water conduit for dislodging earthen material for evacuation by a suction conduit. The evacuated material and water pass through a cyclone separator with the removed air directed through a secondary separator. A blower intake induces low pressure in the separators. Solids and water removed by the first mentioned separator are subjected to screening whereat water is reclaimed and returned to a tank from which a high pressure water pump draws. An air lock receives the earthen material and water from the separator. A modified air lock is disclosed for use with highly abrasive material. The screen is positionable about a horizontal axis by a hydraulic cylinder to maintain desired inclination for maximum dewatering of the evacuated material. A water conduit and valve system permit periodic drawing of water from a secondary tank when the level of the reclaimed water in the recovery tank falls below a certain level. Switches are provided at the site of the ground hole being formed to permit a worker to control both the high pressure water flow and the suction applied by the evacuation tool. An air box is utilized to provide a vacuum source for the evacuation of earthen material in those instances where dislodgement of earthen material is by a suction force alone without high pressure water.

15 Claims, 3 Drawing Sheets

APPARATUS FOR EXCAVATING EARTHEN MATERIAL BY EVACUATION OF SAME

BACKGROUND OF THE INVENTION

The present invention pertains generally to mobile equipment for the forming of and removal of earthen material from a ground hole by a pressurized water flow and suction.

In the uncovering of buried utilities great care should be exerted to avoid contacting the buried utility article with mechanical digging means. Present practice is to remove earthen material, when in the proximity of the buried article, by manual digging which is both time consuming and hence costly. The use of a backhoe machine or drilling equipment encounters the risk of damage to the buried utility article as contact with a pipeline, an electrical cable or fiber optic telephone cable most likely results in damage and costly repair of the utility item. In some cases such contact presents a risk to the equipment operator.

Additionally, the use of mechanical digging equipment is also inefficient as such equipment necessitates transport to and from the digging site. Mechanical digging equipment is also impractical from the standpoint that when only verification of utility depth is necessary by a utility contractor, such can be done by the forming of a relatively small diameter ground hole not possible with commonly used mechanical digging equipment.

U.S. Pat. No. 5,016,717 is of interest in that it discloses a mobile digging apparatus using pressurized water and suction. No provision is made for reuse of water hence a convenient water source is necessary which is not always the case. Further, the excavated dirt and water are collected in a tank which requires periodic dumping resulting in a dumping problem as various governmental prohibitions exist against such dumping at all but approved sites. In certain areas of the United States water shortages exist making the one time use of water to dislodge earthen material impractical from a water conservation standpoint. The transport of a water supply tank and a second or collection tank for water and earthen material is such as to require a vehicle of considerable size and weight to hinder maneuvering in all but large, well surfaced areas.

SUMMARY OF THE PRESENT INVENTION

The present invention is embodied in an apparatus for the digging of ground holes using pressurized water and a suction line to evacuate the water and earthen material with provision made for treating of the water and reuse of same.

A mobile base such as that provided by a medium sized flat bed truck may be utilized with the truck engine serving as a power source for apparatus components. Various hydraulic motors of the apparatus may be driven by a power take-off of the truck transmission.

Pressurized water from a diaphragm pump is ejected in a high velocity stream from a nozzle to loosen the earthen material which may include soil, gravel, sand or a mixture thereof. The loosened material and collected water are evacuated from the hole being formed by a suction line which is preferably combined with the water nozzle in one instrumentality to permit ease of use by one person.

A separator of the apparatus is in upstream communication with a suction source such as the intake side of a blower while water and the earthen material are collected in the separator for initial treatment. A cyclonic separator has been found suitable for such purposes when equipped with an air lock at a discharge outlet of the separator. Air leaving the separator if laden with particles may be subjected to a secondary separator to minimize blower wear. Water and material leaving the air lock equipped separator are directed to a powered screen component which permits the water to gravitate to a catch basin and to a primary tank for reuse in hold formation. The powered rotary screen or trommel discharges solids material at a screen end.

The primary tank noted above provides the major source of water for the operation of the apparatus. A secondary or supplementary tank is in valve regulated communication with the primary tank to provide water to maintain a desired water level in the primary tank. A pump is supplied by the primary tank during system operation while water from the supplementary tank can be drawn at intervals to resupply the primary tank as well as provide water during start-up of the apparatus. Accordingly the secondary tank may be of modest size.

The suction line includes separable segments permitting easy removal of line clogging material.

The use of a diaphragm type pump for a pressurized water source avoids wear and maintenance problems to a large extent encountered with other types of pumps.

Provision is made for putting a second cyclonic filter in line with the suction source for use when working with particularly abrasive earthen material.

Important objectives of the present apparatus include the provision of pressurized water and a suction line to form ground holes and evacuating same with the capability of removing earthen material from the water to permit reuse of same to dispense with burdensome components such as a collection tank for all of the solids and water evacuated from a ground hole being formed, the provision of an apparatus having a combination of a cyclonic separator and a fine screened trommel to remove solids from a return water flow induced by low pressure in a cyclonic separator; the provision of an apparatus with multiple cyclonic separators with use of a second separator being optionable; the provision of an air lock in combination with a cyclonic separator to internally feed water and solids to a powered screen for the initial separation of water and earthen material; the provision of a combination screen, catch basin and primary water tank which may be positioned in relation to a sloped ground surface to maintain an optimum flow rate of solid material through an inclined cylindrical screen; the provision of an apparatus for forming ground holes with a pressurized stream and having a primary water tank automatically re-supplied with water from an auxiliary tank; the provision of an apparatus for the evacuation of earthen material by water and a suction force with remote control elements provided at the evacuation site.

DETAILED DESCRIPTION OF THE PREFERRED EMBODIMENTS

Figures 1, 2:
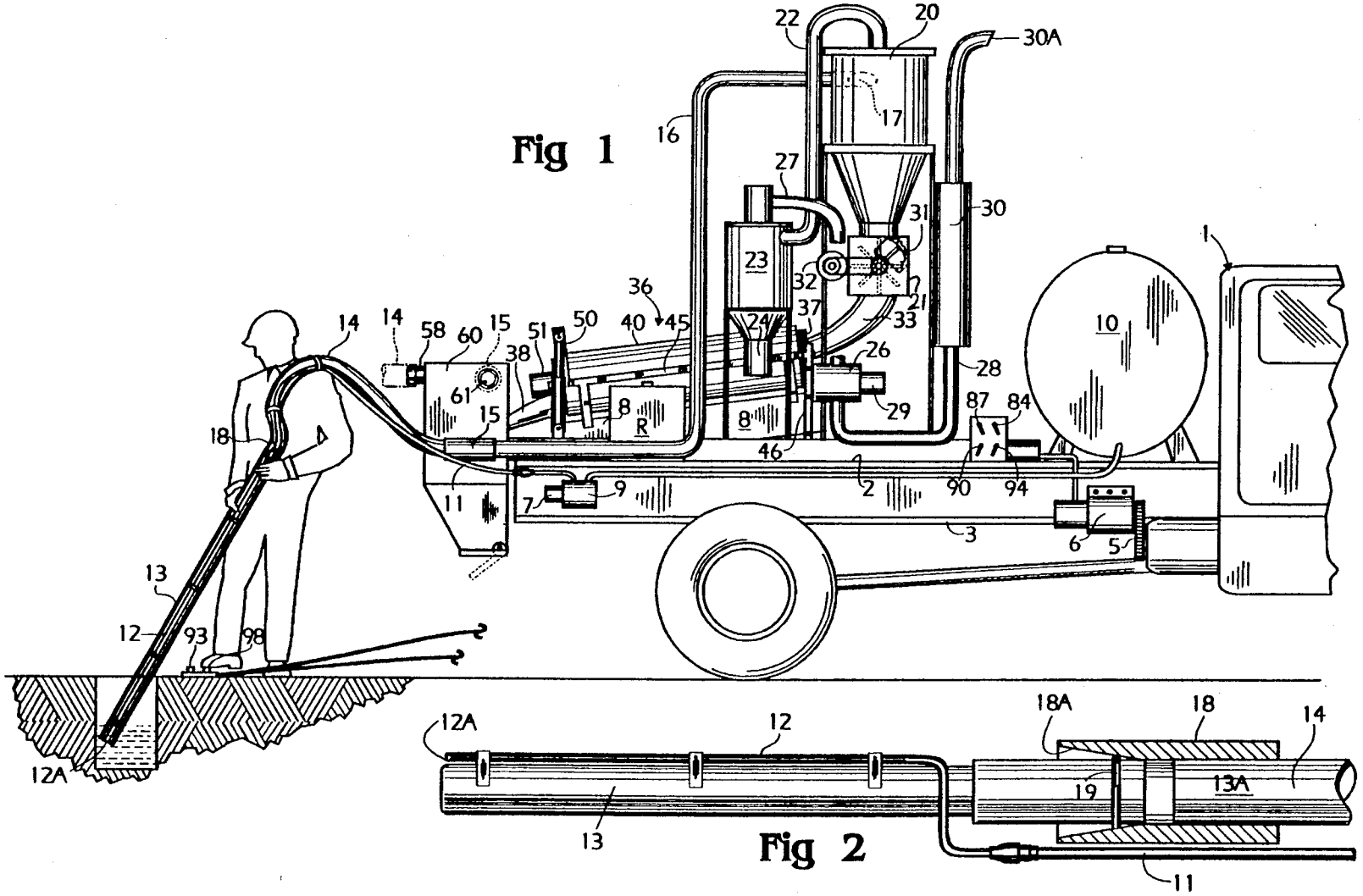
FIG. 1 is a side elevational view of the present apparatus in use forming a ground hole.
FIG. 2 is a fragmentary side elevational view of an evacuation tool equipped with a pressurized water conduit.

With continuing attention to the drawings wherein applied reference numerals indicate parts similarly hereinafter identified, the reference numeral 1 indicates generally a truck having a bed 2 in place on a vehicle frame 3. A truck transmission is of the type having a power take-off 5 for the driving of a hydraulic pump 6.

A hydraulic motor at 7, driven by the output of pump 6, powers a water pump 9 of the diaphragm type to pressurize water drawn from a primary or recovery tank 8 during normal operation of the present apparatus. A secondary tank at 10 provides a water source for the start of an excavation as an alternative source for pump 7. A high pressure water hose 11 is served by pump 9 and terminates in communication with a pipe 12 for high velocity discharge of water at a nozzle 12A. The velocity of the discharge is such as to dislodge most types of earthen material including gravel, soil, etc., to form a ground hole. The dislodged material is evacuated by the following described components.

An evacuation tool includes a rigid vacuum conduit 13 to which water conduit 12 is attached to permit manipulation of both components by one operator. Suitably coupled to conduit 13 by a sleeve 18 is an evacuation hose 14 which is, in turn, coupled at 15 to a conduit at 16 having a discharge end 17 in place on a cyclone separator 20. Accordingly, water and earthen material dislodged thereby are drawn into separator 20 for air removal. Earthen material and water pass downwardly from separator 20 to an airlock device 21 while air from separator 20 is drawn upwardly into an air line 22 for delivery to a secondary separator 23 also of the cyclone type. Airborne particulate, separated out by secondary separator 23, is collected in a canister 24 carried at the lower end of the separator in a detachable manner. A blower at 26 constitutes a source of suction or partial vacuum which is communicated to secondary separator 23 via an air conduit 27. A blower discharge line 28 delivers blower discharge to a muffler 30 having an elevated exhaust 30A. Blower 26 is of the positive displacement type having interengaging lobes and powered by a motor 29 preferably of the hydraulic type.

With attention again to air lock 21, the same may be embodied within a vane equipped rotor 31 driven at a reduced speed by a motor 32. A later described, modified type of air lock may be utilized depending upon the abrasiveness of the earthen material being handled. Rotor 31 discharges material and water received from separator 20 for transfer to a powered screen assembly indicated generally at 36 having a moving screen 37 inclined to promote passage therethrough of earthen material deposited into the uppermost end of the screen by a chute 33 which projects into the screen end. Screen 37 is cylindrical and operates in the manner of a trommel permitting water to pass through the screen while the solids tumble and migrate lengthwise of the screen for discharge via a discharge chute 38. Screen 37 may be of No.,100 mesh to prevent all but the smallest of solid particles from passage therethrough into a cylindrical screen housing 40 which collects the water and directs same into recovery tank 8. Tank 8 has an upper wall 8A-8B sloped to provide converging top wall segments which direct water received from housing 40 to a screened inlet 43. Screen assembly 36 additionally includes a support framework 45 including a pair of rails 49 extending along opposite sides of screen housing 40 with the housing welded to said rails by means of spacer elements 44 spaced therealong. Upright members as at 46 pivotally support the framework 45 for movement about the horizontal axis of pivot pins as at 47. A hydraulic cylinder 50, at the opposite end of the framework, imparts movement to the screen assembly to lift and lower same about the horizontal axis of pivot pins 47. Accordingly, regardless of the attitude of truck bed 2 which will vary with the road surface or terrain, the screen assembly may be inclined manner to provide the desired duration during which solids will be subjected to screening by screen 37. Hydraulic cylinder 50 is coupled to the rearward end of framework 45 and imparts movement to same about the pivot pins 47. Recovery tank 8 is carried by frame members 45A of framework 45 and to at all times provide the lowermost end of the tank being that end at which a tank outlet valve 52 is provided to assure full utilization of water in the tank regardless of vehicle attitude. A hydraulic motor 51 is carried by a cross member 53 of frame 45 and drives a screen spindle 54 journalled in a bearing carried by a second or forward cross member 55 at the uppermost forward end of the frame. The rotational speed of screen 37 may be varied by regulating the flow of hydraulic fluid to motor 51 by a flow control valve 56 shown in the hydraulic system schematic of FIG. 7. The dewatered discharge of screen assembly 36 greatly facilitates the removal of same to an acceptable waste site or the use of same to backfill the hole evacuated.

Indicated at 60 is a vacuum box for the collection of solids evacuated from a ground hole being formed without using a pressurized water flow. In certain ground conditions evacuation may be entirely possible without requiring the use of a pressurized water flow for dislodgement of earthen particles. In such instances vacuum box 60 is utilized by the putting of conduit 16, and particularly coupling 15 thereon, into place on a collar 61 on the box to apply a reduced pressure to the box interior. Similarly, suction hose 14, subsequent to being separated from coupling 15, is applied to a second collar 58 on vacuum box 60 to permit the discharge of solids into same with subsequent gravitational separation of the solids in the box. The cyclone separators 20 and 24 are relied upon for the removal of particulates from the air drawn from the vacuum box via conduit 16. The screen assembly 36 is deactivated during vacuum box use.

Figures 3, 4, 5, 6:
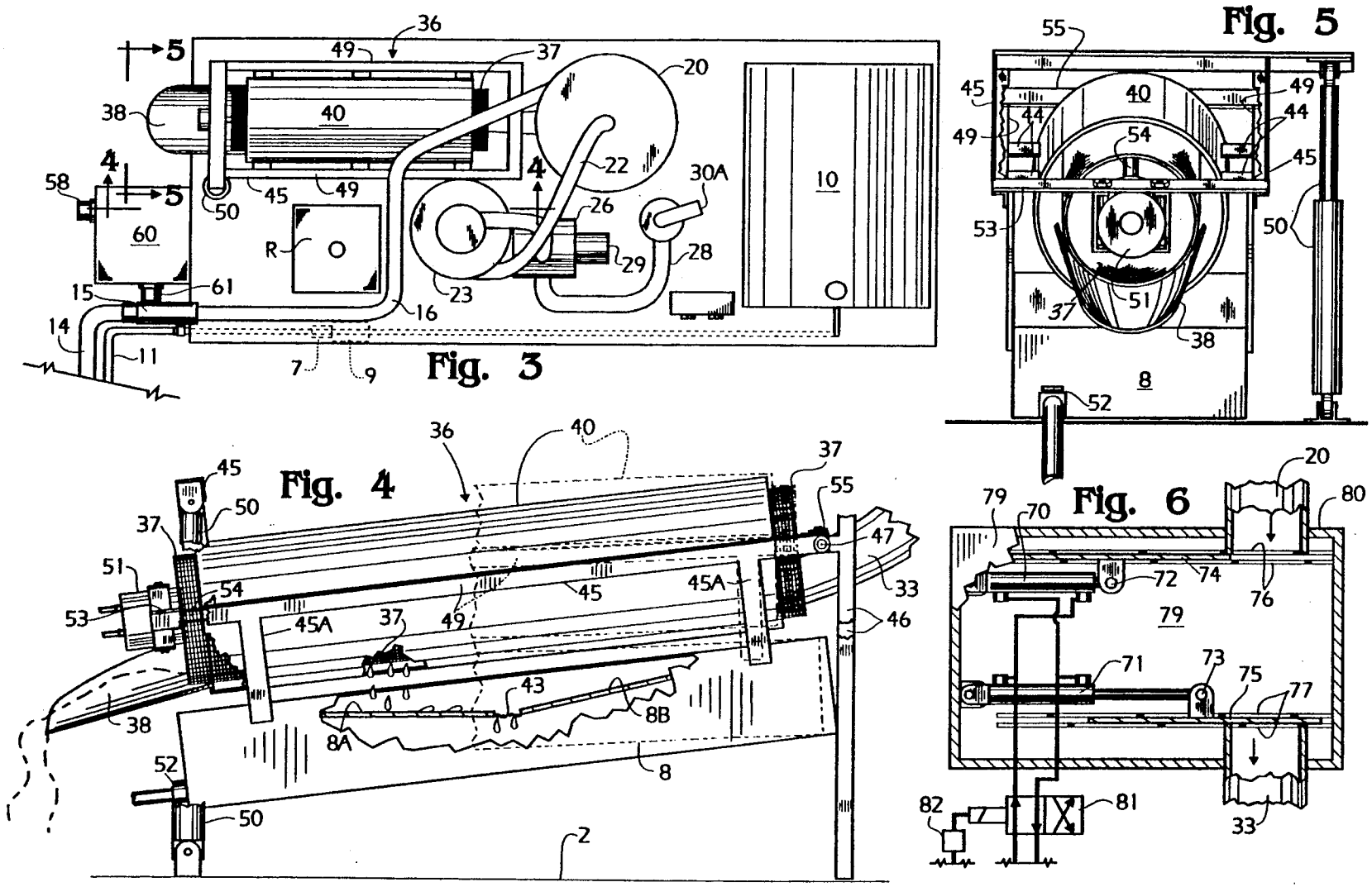
FIG. 3 is a plan view of the apparatus shown in FIG. 1.
FIG. 4 is a vertical sectional view taken approximately along line 4—4 of FIG. 3.
FIG. 5 is an end elevational view taken along line 5—5 of FIG. 4.
FIG. 6 is a vertical sectional view of a modified air lock in receiving communication with a cyclone separator of the present apparatus.

With attention to FIG. 6 the modified air lock shown therein is particularly suited for the handling of abrasive material and utilizes a pair of hydraulic cylinders 70 and 71 each having piston rods coupled at 72 and 73 to slidable plates 74 and 75 mounted in channels 76 and 77 affixed to side walls as at 79 of an air lock housing unit 80. The cylinders 70 and 71 are actuated simultaneously by means of a four-way two position valve 81 of the solenoid operated type. The cylinder actuated plates 74 and 75 move in opposite directions to open and close ducts in communication with the interior of cyclone separator 20. Accordingly, material and water discharged from cyclone separator 20 is deposited onto plate 74 from which it is eventually discharged downwardly towards plate 75 which has moved to a duct closing position as shown in full lines. At all times, a reverse or upward flow of air into the base of cyclone separator 20 is prevented by plate 74 or plate 75. Valve 81 is activated at intervals determined by a timer at 82.

Figure 7:
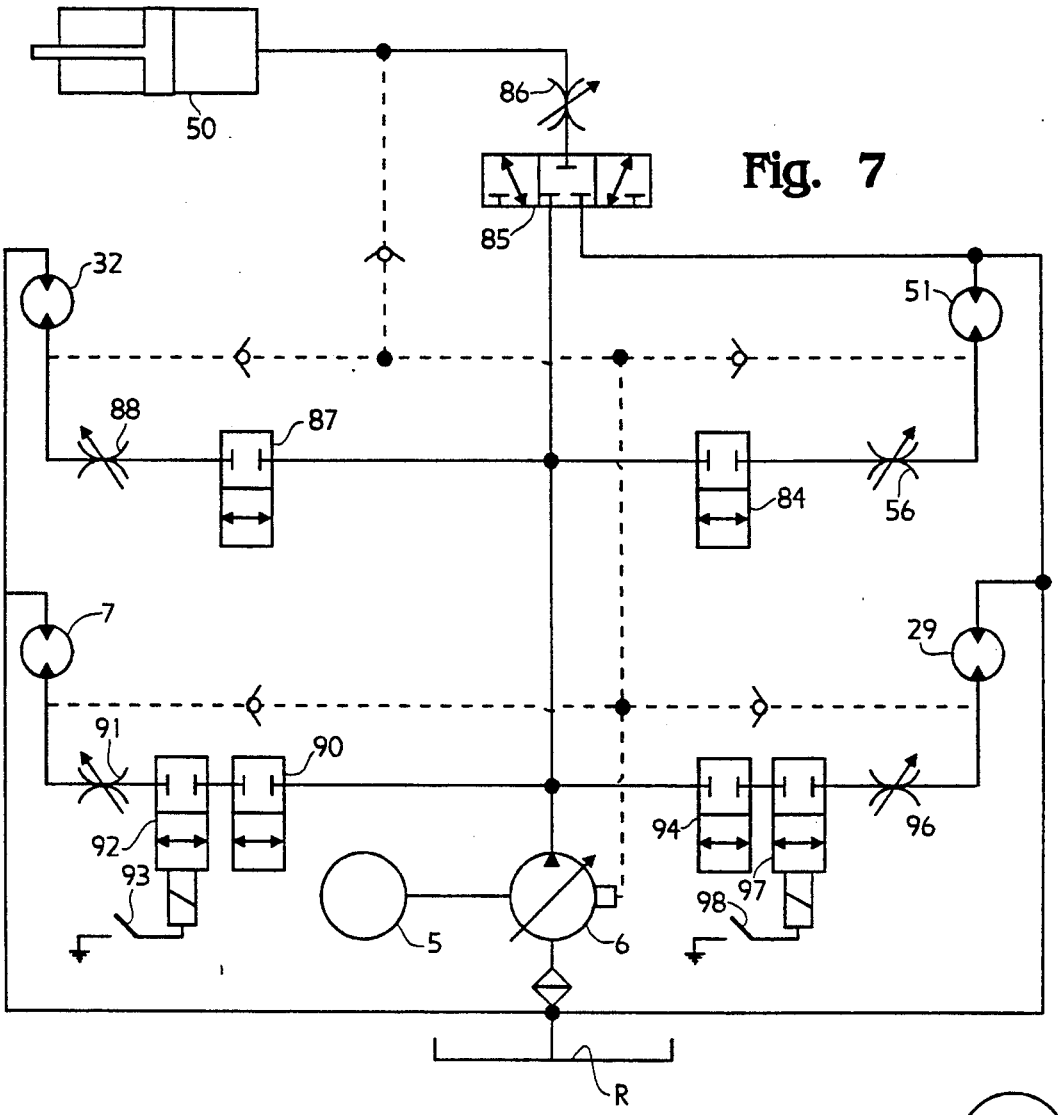
FIG. 7 is a hydraulic schematic of the present apparatus.

With attention now to the hydraulic schematic of FIG. 7, screen motor 51 is powered by pump 6 with an on-off valve at 84 and flow control valve 56. The screen assembly positioning cylinder 50 receives a fluid flow controlled by a three-way valve 85 with a flow control valve at 86. Cylinder 50 may be of the single acting type.

For driving air lock motor 32 a manually controlled on-off valve 87 is provided along with a flow control valve at 88.

Motor 7 driving water pump 9 is provided with a hydraulic flow via an on-off valve 90 and a flow control valve at 91. To permit remote control by a worker stationed at the work site an on-off valve at 92 is of the solenoid operated type with the solenoid in circuit with a power source via a remote switch 93 which is preferably of the foot actuated type.

Blower motor 29 is provided with a fluid flow controlled by an on-off valve 94 and a flow control valve 96. To permit remote control by a worker at the work site a second on-off valve at 97 is of the solenoid type in circuit with a foot actuated switch 98. From the flow drawing it will be seen that the worker may control both the water flow from pump 9 as well as evacuation suction through conduit 13 from the worker's station.

Figure 8:
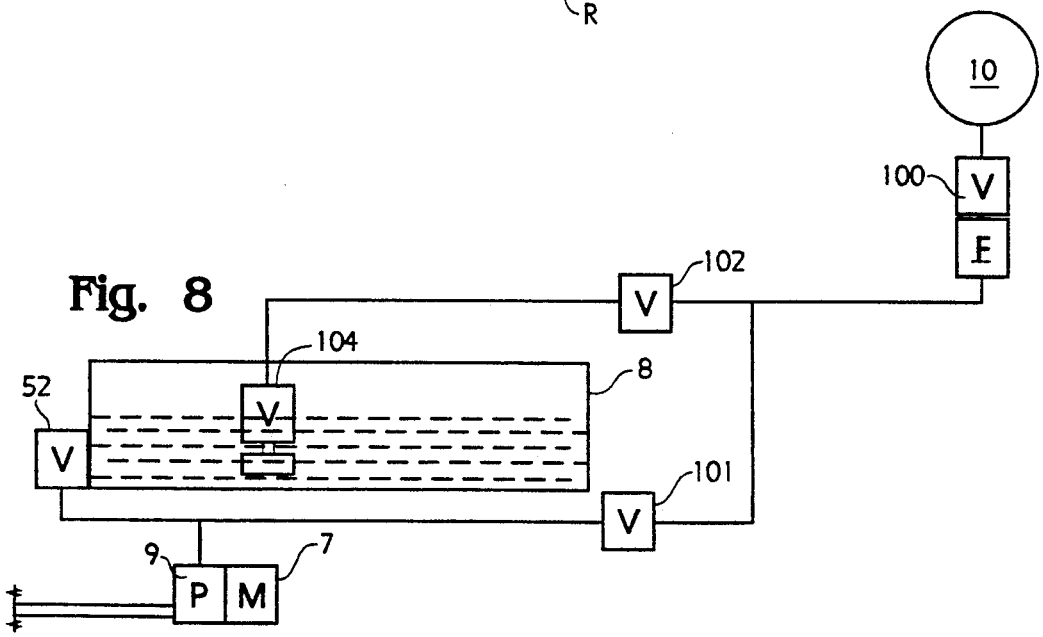
FIG. 8 is a water flow schematic of the present apparatus.

With attention now to the water flow schematic of FIG. 8, secondary tank 10 provides an initial flow of water to pump 9 during startup of the apparatus by the opening of shutoff valves 100 and 101 with a shutoff valve 102 being closed. Upon the water level in primary or recovery tank 8 reaching a predetermined level from evacuated water, collected from screen assembly 36, a shutoff valve 52 is opened to provide a water source for pump 9 for reuse of recovered water. To provide automatic supplementing of the recovered water in tank 8, the shutoff valve 102 is opened to permit automatic replenishing of tank 8 by means of a float operated valve 104 therein, valve 101 is closed during automatic replenishing of water in tank 8 from tank 10.

For periodically removing debris and cleaning of conduits 13 and 14 a quick disconnect feature is provided which includes sleeve 18 with a conical internal segment at 18A. An O-ring at 19 on an enlarged end 13A of conduit 13 provides a friction tight and an air tight connection with sleeve segment 8A yet permits manual extraction of the enlarged end 13A of conduit 13 for debris removal.

Water pump 9 may be a rotary diaphragm type as for example that pump manufactured and sold by Wanner Engineering, Inc., under the trademark Hydra-Cell Model D10/8.

Blower 26 may be rated at 250–500 (or more) CFM and is of the double rotor type.

Screen 37 may be of No., 100 mesh and rotated by motor 51 at speeds in the range of 30–70 RPM with screen speeds being in the higher range for lighter density earthen material.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

I claim:

1. An apparatus for excavating earthen material by evacuation and comprising, a mobile base including a power source and a hydraulic pump powered thereby water conduit means for the delivery of a pressurized water stream to an excavation site for the dislodgement of earthen material, suction conduit means for applying suction to the site for the removal of the water and dislodged earthen material, an air separator in receiving communication with said suction conduit means, a vacuum source in communication with said air separator, discharge means for controlling a discharge of earthen material and water from said separator while restricting a flow of air into said air separator, a powered screen assembly receiving earthen material and water discharged from said discharge means and serving to at least partially separate said earthen material and water, pivot means supporting said screen assembly, a primary water tank into which water is received from said powered screen assembly, a supplemental water tank, valve and conduit means for providing a water flow from said supplemental water tank to said primary water tank to compensate for water not recovered by the apparatus at the excavation site, and water pump means normally in upstream communication with said primary water tank and having an outlet port in downstream communication with said water conduit means.

2. The apparatus claimed in claim 1 wherein said suction conduit means is of segmented construction to facilitate disassembly and removal of obstructions therefrom.

3. The apparatus claimed in claim 1 additionally including an additional separator for communication with said air separator and with said vacuum source.

4. The apparatus claimed in claim 3 wherein said air separator is of the cyclonic type.

5. The apparatus claimed in claim 1 wherein said discharge means is an air lock of the rotary vane type.

6. The apparatus claimed in claim 1 additionally including a chute receiving material and water from said discharge means, said chute having a discharge end for the discharge of material and water into said powered screen assembly.

7. The apparatus claimed in claim 6 wherein said powered screen assembly includes a screen of cylindrical configuration, the chute discharge end disposed internally in said screen.

8. The apparatus claimed in claim 7 wherein said screen assembly includes a housing adjacent said screen and receiving water discharged through said screen, said primary water tank located below said screen and said housing for the gravitational flow of water passing through said screen.

9. The apparatus claimed in claim 8 wherein said screen assembly and said primary water tank are movably mounted on said mobile support for movement in an upright plane, means coupled to said screen assembly to position said screen assembly in said plane to compensate for changes in the attitude of the mobile base to assure a desired flow rate of material axially through the screen.

10. The apparatus claimed in claim 1 wherein said valve and conduit means includes a float disposed in said primary water tank for automatic resupplying of said primary water tank from said supplemental tank.

11. The apparatus claimed in claim 10 additionally including valves in communication with said pump means for selecting said primary water tank or said supplemental water tank as a source for said pump means.

12. The apparatus claimed in claim 1 wherein said water pump means is of the type having a diaphragm, a hydraulic motor coupled to said pump means, a remotely controlled valve controlling hydraulic fluid flow to said hydraulic motor to regulate the output of said water pump means, operator controlled switch means in circuit with said remotely controlled valve to enable control of said hydraulic motor and said pump output from the excavation site.

13. The apparatus claimed in claim 1 wherein said vacuum source is a blower, a hydraulic motor coupled to said blower, a remotely controlled hydraulic valve regulating fluid flow to said motor, operator controlled switch means in circuit with said remotely controlled hydraulic valve to permit control of the blower from the excavation site.

14. The apparatus claimed in claim 1 wherein said discharge means includes a housing having an inlet and an outlet, plates slidably carried by said housing one each adjacent said inlet and said outlet, plate actuating means coupled to said plates and operable to position said plates to open and close said inlet and said outlet.

15. The apparatus claimed in claim 14 wherein said plate actuating means includes hydraulic cylinders one each coupled to one of said plates, valve means controlling fluid flow to said cylinders to position said plates to prevent an airflow through said inlet and said outlet of the housing while intermittently discharging earthen material and water from said housing.

* * * * *